US011165150B2

(12) United States Patent
Park et al.

(10) Patent No.: US 11,165,150 B2
(45) Date of Patent: Nov. 2, 2021

(54) DUAL POLARIZATION ANTENNA WITH HIGH ISOLATION

(71) Applicant: Korea Advanced Institute of Science and Technology, Daejeon (KR)

(72) Inventors: Chulsoon Park, Daejeon (KR); Honghyun Bae, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 33 days.

(21) Appl. No.: 16/786,034

(22) Filed: Feb. 10, 2020

(65) Prior Publication Data

US 2021/0203069 A1 Jul. 1, 2021

(30) Foreign Application Priority Data

Dec. 30, 2019 (KR) ..... 10-2019-0177634

(51) Int. Cl.
*H01Q 1/52* (2006.01)
*H01Q 9/04* (2006.01)
(Continued)

(52) U.S. Cl.
CPC ..... *H01Q 1/526* (2013.01); *H01Q 9/045* (2013.01); *H01Q 9/0457* (2013.01);
(Continued)

(58) Field of Classification Search
CPC .. H01Q 9/0428; H01Q 9/0435; H01Q 21/062; H01Q 9/045; H01Q 9/16;
(Continued)

(56) References Cited

U.S. PATENT DOCUMENTS 7,486,239 B1 * 2/2009 Channabasappa ... H01Q 9/0414 343/700 MS
10,756,436 B2 * 8/2020 Tekin ..... H01Q 9/0407
(Continued)

*Primary Examiner* — Vibol Tan
(74) *Attorney, Agent, or Firm* — Daly Crowley Mofford & Durkee, LLP

(57) ABSTRACT

A dual-polarized antenna with high isolation is disclosed. A first differential signal feeding unit extends from a first input port toward one side of a patch radiator through a dielectric substrate, and is branched into a balun structure to provide first and second feeding probes for differentially feeding vertically polarized signals to opposite first and second portions of the patch radiator. A second differential signal feeding unit extends from a second input port toward another side of the patch radiator through the dielectric substrate, and is branched into the balun structure to provide third and fourth feeding probes for differentially feeding horizontally polarized signals to opposite third and fourth portions of the patch radiator. When feeding the vertically polarized signals through the first and second feeding probes, a virtual ground region in which there is little electric field is formed in the center portion of the patch radiator. The cross-sectional polarization components of the third and fourth probes are also greatly reduced, so that they hardly exist. A soft surface structure surrounding the patch radiator and the first to fourth probes can improve the radiation pattern deterioration caused by diffraction of surface waves.

16 Claims, 9 Drawing Sheets

(51) Int. Cl.
*H01Q 9/06* (2006.01)
*H01Q 9/16* (2006.01)

(52) U.S. Cl.
CPC ..... *H01Q 9/0485* (2013.01); *H01Q 9/065* (2013.01); *H01Q 9/16* (2013.01)

(58) Field of Classification Search
CPC .... H01Q 21/061; H01Q 9/0485; H01Q 9/285; H01Q 1/526; H01Q 9/065; H01Q 9/0457; H01Q 9/04592
See application file for complete search history.

(56) References Cited

U.S. PATENT DOCUMENTS

| | | | | |
|---|---|---|---|---|
| 10,784,590 | B2 * | 9/2020 | Maccabe | H01Q 19/10 |
| 10,840,599 | B2 * | 11/2020 | Foo | H01Q 1/2283 |
| 2020/0014121 | A1 * | 1/2020 | Maccabe | H01Q 9/27 |
| 2020/0127379 | A1 * | 4/2020 | Tekin | H01Q 9/045 |

* cited by examiner (A)

(B)

DUAL POLARIZATION ANTENNA WITH HIGH ISOLATION

CROSS-REFERENCE TO RELATED APPLICATION

This U.S. non-provisional application claims priority under 35 USC § 119 from Korean Patent Application No. 10-2019-0177634, filed on Dec. 30, 2019 in the Korean Intellectual Property Office (KIPO), the disclosure of which is hereby incorporated by reference in its entirety.

BACKGROUND

1. Technical Field

The present disclosure relates to the field of antennas for wireless communication, and more particularly, to a dual-polarized antenna for a high-speed wireless communication system.

2. Description of the Related Art

The dual-polarized antenna is an antenna for simultaneously transmitting separate multiplexed signals on two carriers without interference at the same frequency. The dual-polarized antenna is used for a technology capable of reusing frequencies by transmitting and receiving wireless carrier signals in vertical polarization and horizontal polarization.

Conventionally, flat-type dual-polarized antennas have been used widely because they can increase the data transmission rate twice while having a small size at the same time. However, when the dual polarizations of the flat-type antenna share the same radiator, the isolation between the dual polarizations is not secured to a level suitable for multi-input-multi-output (MIMO) wireless communication.

In addition, in the flat-type dual-polarized antennas a signal trapped by and rotated within a dielectric is mixed with a signal radiated from a patch, thereby reducing the antenna gain and causing ripple in the radiation pattern.

SUMMARY

The present disclosure is based on the awareness of the problems of the prior art mentioned above. The present disclosure is directed to provide a dual-polarized antenna that can ensure high isolation between double polarized waves in the broadband even if the same radiator is shared by the double polarized waves by creating a virtual ground in the radiator through differential-signal-feeding to the radiator.

The problem to be solved by the present disclosure is not limited to the above-described problems, and may be variously extended without departing from the spirit and scope of the disclosure.

Some embodiments of the present inventive concept to realize the object provide a dual-polarized antenna a dielectric substrate, a conductive patch radiator, a first differential signal feeding unit, and a second differential signal feeding unit. The conductive patch radiator is laminated on a top surface of the dielectric substrate and having a predetermined size and shape. The first differential signal feeding unit is disposed on the dielectric substrate, and configured to convert a vertically polarized signal into first and second vertically polarized differential signals having a phase difference of 180 degrees between each other to be fed in ±first directions toward a center of the conductive patch radiator from opposite sides about the center of the conductive patch radiator. The second differential signal feeding unit is disposed on the dielectric substrate, and configured to convert a horizontally polarized signal into first and second horizontally polarized differential signals having a phase difference of 180 degrees between each other to be fed in ± second directions toward the center of the conductive patch radiator from opposite sides about the center of the conductive patch radiator.

In example embodiments, the first differential signal feeding unit may include a first single stripline to which the vertically polarized signal is fed; first and second differential feeding striplines branched from an end of the first single stripline into a balun structure and having a length difference corresponding to half of a wavelength ($\lambda_v$) of the vertically polarized signal between each other; and first and second probes extending from ends of the first and second differential feeding striplines to vicinities of first and second edges of the conductive patch radiator to feed the first and second vertically polarized differential signals in the ±first direction, respectively.

In example embodiments, the second differential signal feeding unit may include a second single stripline to which the horizontally polarized signal is fed; third and fourth differential feeding striplines branched from an end of the second single stripline into a balun structure and having a length difference corresponding to half of a wavelength ($\lambda_h$) of the horizontally polarized signal between each other; and third and fourth probes extending from ends of the third and fourth differential feeding striplines to vicinities of third and fourth edges of the conductive patch radiator to feed the first and second horizontally polarized differential signals in the ± second direction, respectively.

In example embodiments, the dual-polarized antenna may further include a soft surface structure unit configured to improve radiation characteristics by suppressing a surface wave propagating through a surface portion of the dielectric substrate. The soft surface structure unit may include a horizontal roof unit formed of a conductive stripline surrounding at least the patch radiator, feeding probes of the first differential signal feeding unit for feeding the first and second vertically polarized differential signals to the patch radiator, respectively, and feeding probes of the second differential signal feeding unit for feeding the first and second horizontally polarized differential signals to the patch radiator, respectively; and a conductive vertical fence unit coupled to a bottom surface of the horizontal roof unit and extending downward to be ground.

In example embodiments, the conductive stripline may protrude a predetermined length ($L_{strip}$) in a horizontal direction from a top of the vertical fence unit toward the patch radiator to form an annular horizontal roof unit covering a top surface of the dielectric substrate. The soft surface structure unit may satisfy a condition of '$2L_{strip}+H=\lambda_g/2$', where H is a height of the vertical fence unit, $L_{strip}$ is a length where the horizontal roof unit protrudes horizontally from the top of the vertical fence part, and $\lambda_g$ is a wavelength of feed signal in the dielectric substrate.

In example embodiments, the dual-polarized antenna may further include a first input port, disposed on a side of the dielectric substrate, and through which the vertically polarized signal is input; a second input port, disposed on another side of the dielectric substrate, and through which the horizontally polarized signal is input; and a grounding unit, disposed to be grounded at a predetermined position of the dielectric substrate, and configured to electromagnetically shield the patch radiator and the first and second differential signal feeding units from an outside.

In example embodiments, the first direction is substantially orthogonal to the second direction on the same plane.

Meanwhile, a dual-polarized antenna according to some embodiments for realizing the object of the present disclosure includes a dielectric substrate, a conductive patch radiator, a first input port, a second input port, a first differential signal feeding unit, a second differential signal feeding unit, and a grounding unit. The conductive patch radiator may be laminated on a top surface of the dielectric substrate and have a predetermined size and shape. The first input port may be disposed on a side of the dielectric substrate, and a vertically polarized signal may be input through the first input port. The second input port may be disposed on another side of the dielectric substrate, and a horizontally polarized signal may be input through the second input port. The first differential signal feeding unit may extend from the first input port toward one side of the patch radiator through the dielectric substrate, and be branched into a balun structure to provide first and second feeding probes for differentially feeding vertically polarized signals to first and second portions, opposite to each other, of the patch radiator. The second differential signal feeding unit may extend from the second input port toward another side of the patch radiator through the dielectric substrate, and be branched into a balun structure to provide third and fourth feeding probes for differentially feeding horizontally polarized signals to third and fourth portions, opposite to each other, of the patch radiator. The ground unit may be disposed to be grounded at a predetermined position of the dielectric substrate to electromagnetically shield the patch radiator and the first and second differential signal feeding units from an outside.

In example embodiments, the dual-polarized antenna may further include a soft surface structure unit configured to improve radiation characteristics by suppressing a surface wave propagating through a surface portion of the dielectric substrate. The soft surface structure unit may include an annular conductive vertical fence unit and a donut-shaped conductive horizontal roof unit. The conductive vertical fence unit may be formed so as to surround the patch radiator, the first and second feeding probes, and the third and fourth feeding probes. The conductive horizontal roof unit may be coupled to the upper end of the vertical fence unit along the upper end of the vertical fence unit, and protrude a predetermined length ($L_{strip}$) in the horizontal direction toward the patch radiator.

In exemplary embodiments, the conductive vertical fence unit of the soft surface structure unit may include a plurality of vertical conductive pillars constituting an annular fence by filling a plurality of vertical via holes provided at predetermined intervals along an annular closed line in the dielectric substrate, wherein a cross-sectional shape of a combination of the conductive vertical fence unit and the horizontal roof unit is an inverted L-shape.

In example embodiments, the soft surface structure unit may satisfy a condition of '$2L_{strip}$ $H=\lambda_g/2$. Here, H is a height of the vertical fence unit, $L_{strip}$ is a length where the horizontal roof unit protrudes horizontally from the top of the vertical fence part, and $\lambda_g$ is a wavelength of feed signal in the dielectric substrate.

In example embodiments, the grounding unit may include a first ground plate laminated on the bottom surface of the dielectric substrate; and a second ground plate disposed inside the dielectric substrate while being above the first and second differential signal feeding units, and the grounding unit is configured to electromagnetically shield the first and second differential signal feeding units from outside.

In example embodiments, the first differential signal feeding unit may include a first single signal line and first and second signal feeding probe units. The first single signal line may be connected to the first input port and extend toward the patch radiator. The first and second feeding probe units may be branched into two lines of a balun structure from an end of the first single signal line and extending to vicinities of first and second portions of the patch radiator, respectively. The first and second portions may be located opposite to each other based on a center of the patch radiator on a first straight line passing through the center of the patch radiator, and a difference in length between the first and second feeding probe units may be substantially equal to half a wavelength ($\lambda_w$) of a vertically polarized signal input to the first input port.

In example embodiments, the first single signal line may include a first transition unit and a first single stripline. The first transition unit may be connected to the first input port and extending downward to a predetermined depth in the dielectric substrate. The first single stripline may extend from a distal end of the first transition unit by a predetermined length in a horizontal direction toward the patch radiator in the dielectric substrate. The first and second feeding probe units may include first and second differential striplines and L-shaped first and second probes. The first and second differential striplines may be branched in opposite directions along the first straight line at a distal end of the first single stripline so as to have a length difference equal to half the wavelength ($\lambda_v$) of the vertically polarized signal. The L-shaped first and second probes may extend upward from distal ends of the first and second differential striplines to a predetermined level in the dielectric substrate, and then bent to extend horizontally to the first and second portions, respectively.

In example embodiments, the second differential signal feeding unit may include a second single signal line, and third and fourth feeding probe units. The second single signal line may be connected to the second input port and extend toward the patch radiator. The third and fourth feeding probe units may be branched into two lines of a balun structure from an end of the second single signal line and extending to vicinities of third and fourth portions of the patch radiator, respectively. The third and fourth portions may be located on opposite sides to each other based on a center of the patch radiator on a second straight line passing through the center of the patch radiator, and a difference in length between the third and fourth probe units may be substantially equal to half a wavelength ($\lambda_h$) of a horizontally polarized signal input to the second input port.

In example embodiments, the second single signal line may include a second transition unit and a second single stripline. The second transition unit may be connected to the second input port and extend downward to a predetermined depth in the dielectric substrate. The second single stripline may extend from a distal end of the second transition unit by a predetermined length in a horizontal direction toward the patch radiator in the dielectric substrate. The third and fourth feeding probe units may include third and fourth differential striplines and L-shaped third and fourth probes. The third and fourth differential striplines may be branched in opposite directions along the second straight line at a distal end of the second single stripline so as to have a length difference equal to half the wavelength ($\lambda_h$) of the horizontally polarized signal. The L-shaped third and fourth probes may extend upward from distal ends of the third and fourth differential striplines to a predetermined level in the dielectric substrate, and then bent to extend horizontally to the third and fourth portions, respectively.

In example embodiments, the first and second portions may be located on a first straight line, and the third and fourth portions may be located on a second straight line orthogonal to the first straight line in the same plane.

In example embodiments, the first and second differential signal feeding units may be electromagnetically coupled to the patch radiator.

The dual-polarized antenna device according to the example embodiments of the present disclosure can have an isolation between the dual-polarized signals at a high level suitable for the MIMO wireless communication and provide a wider frequency bandwidth at the same time due to differential feeding of dual-polarized signals to the patch antenna.

In the dual-polarized antenna device according to the example embodiments of the present disclosure can have high isolation between the dual polarizations in a wider frequency bandwidth by differentially feeding both the dual-polarized signals to the patch radiator.

In addition, according to the present disclosure, side lobes and ripples which may be generated by diffraction of radio waves trapped-propagating inside the dielectric substrate can be greatly reduced by introducing the soft surface structure, and characteristics of the vertically polarized radiation pattern can be greatly improved.

BRIEF DESCRIPTION OF THE DRAWINGS

Exemplary and non-limiting embodiments will be more clearly understood from the following detailed description made in connection with the accompanying drawings.

DETAILED DESCRIPTION OF THE EMBODIMENTS

Figure 1:
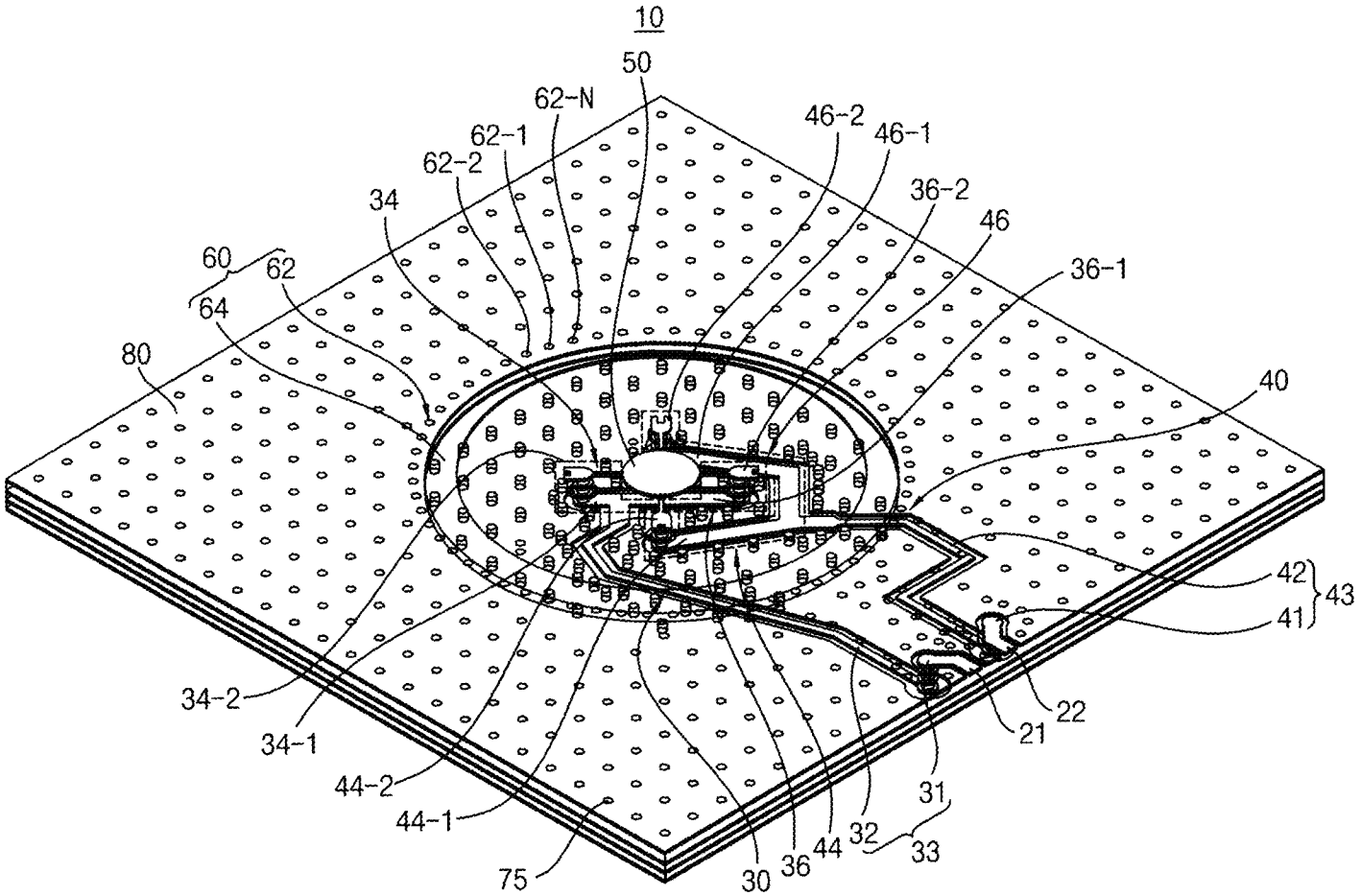
FIG. 1 is a perspective view showing a structure of a dual-polarized antenna having high isolation between dual polarizations according to an exemplary embodiment of the present disclosure.

Hereinafter, preferred example embodiments of the present disclosure will be described in detail with reference to the accompanying drawings. The same reference numerals will be used for the same elements in the drawings, and duplicate descriptions for the same elements will not be given.

With respect to the example embodiments of the present disclosure disclosed below, descriptions for specific structures or functions will be given as examples only for the purpose of illustrating the embodiments of the present disclosure. Embodiments of the present disclosure may be implemented in various forms, and should not be construed as being limited to the embodiments described in the specification. That is, the present disclosure may be modified to various changes, and may have various forms, and specific embodiments will be illustrated in the drawings and described in detail in the disclosure. However, this is not intended to limit the present disclosure to a specific disclosure form, it should be understood to include all modifications, equivalents, and substitutes included in the spirit and scope of the present disclosure.

The terms used in the present disclosure are only used to describe specific embodiments, and are not intended to limit the present disclosure. Singular expressions include plural expressions unless the context clearly indicates otherwise. In this application, terms such as "include" or "have" are intended to indicate that there are features, numbers, steps, operations, components, parts, or combinations thereof described in the specification, and one or more other features. It should be understood that the existence or addition possibilities of features or numbers, steps, operations, elements, parts or combinations thereof are not excluded in advance. Further, terms such as first and second may be used to describe various elements, but the elements should not be limited by the terms. The terms are used only for the purpose of distinguishing one element from other elements.

Figure 2:
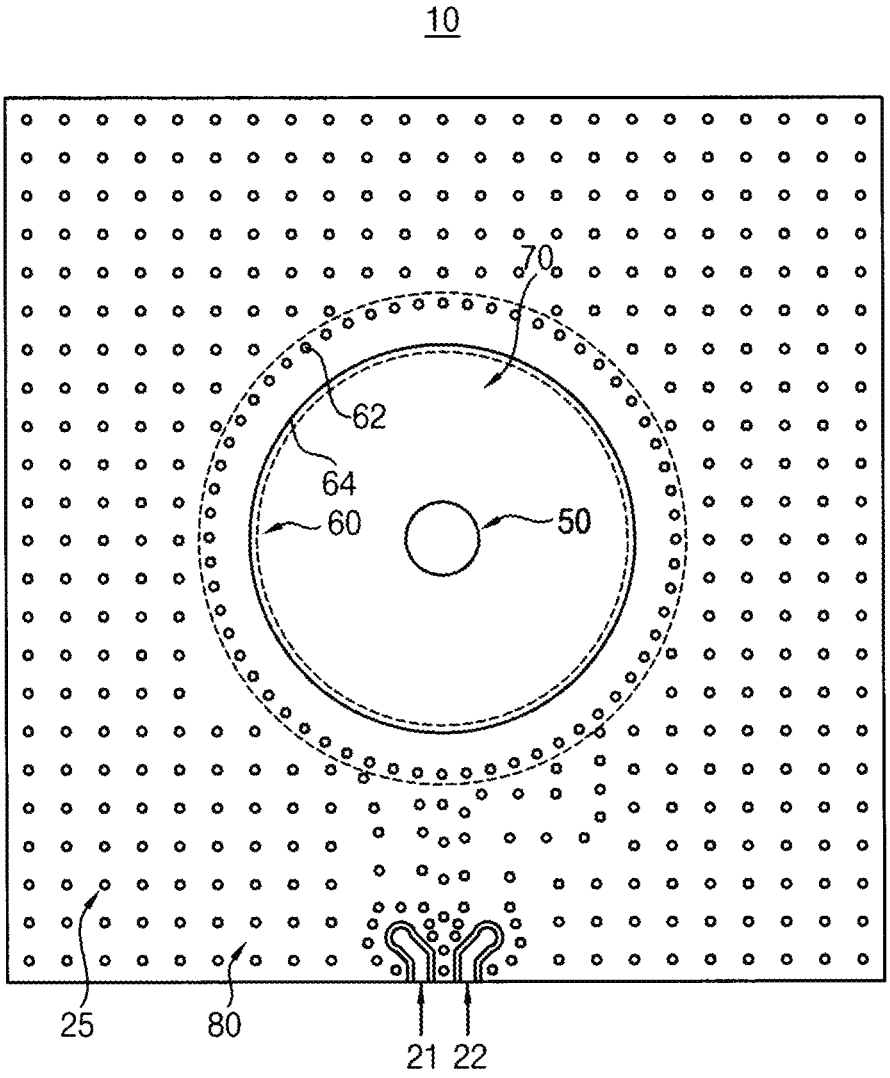
FIG. 2 shows a top surface of the dual-polarized antenna shown in FIG. 1.
Figure 3:
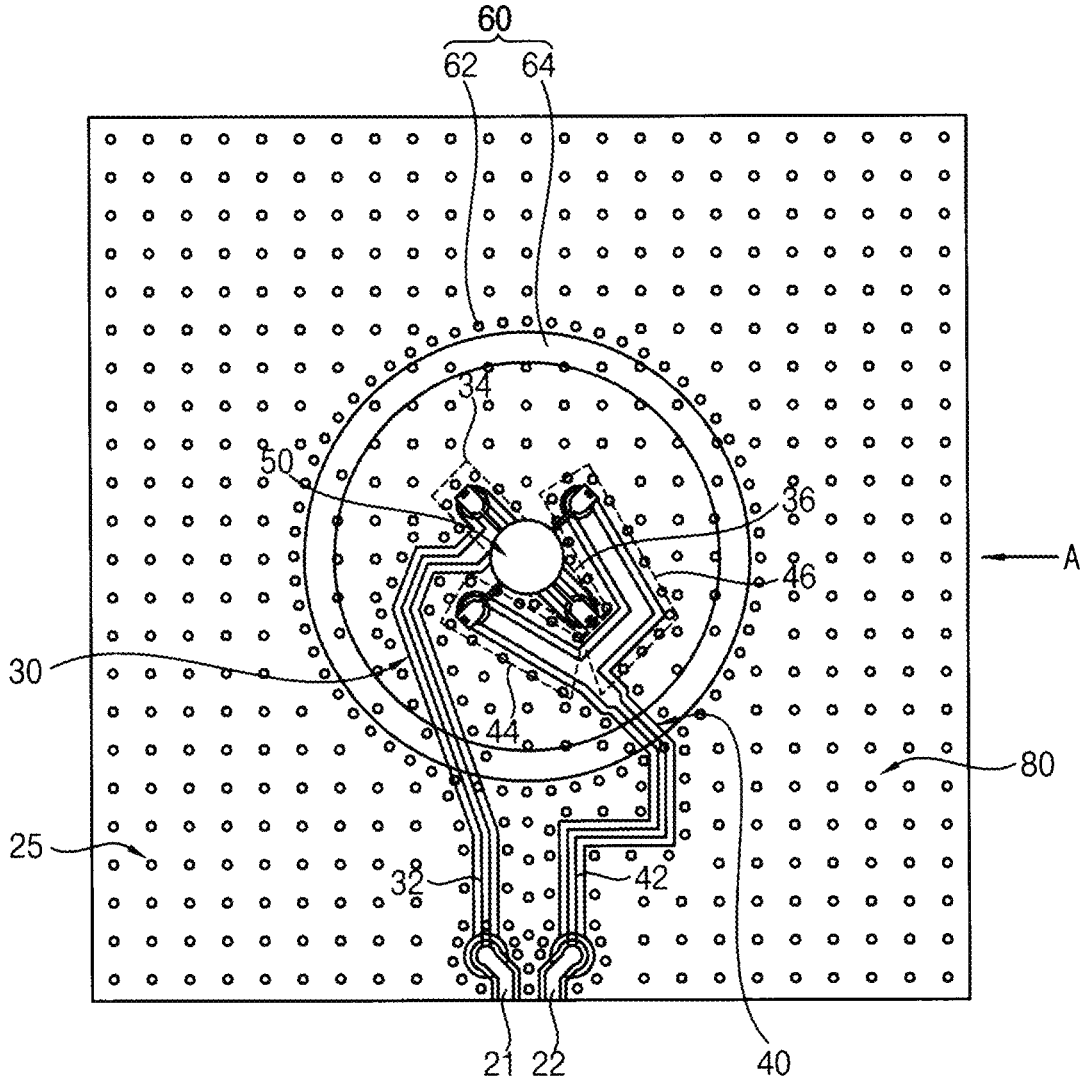
FIG. 3 shows a main configuration inside the dual-polarized antenna shown in FIG. 1.
Figure 4:
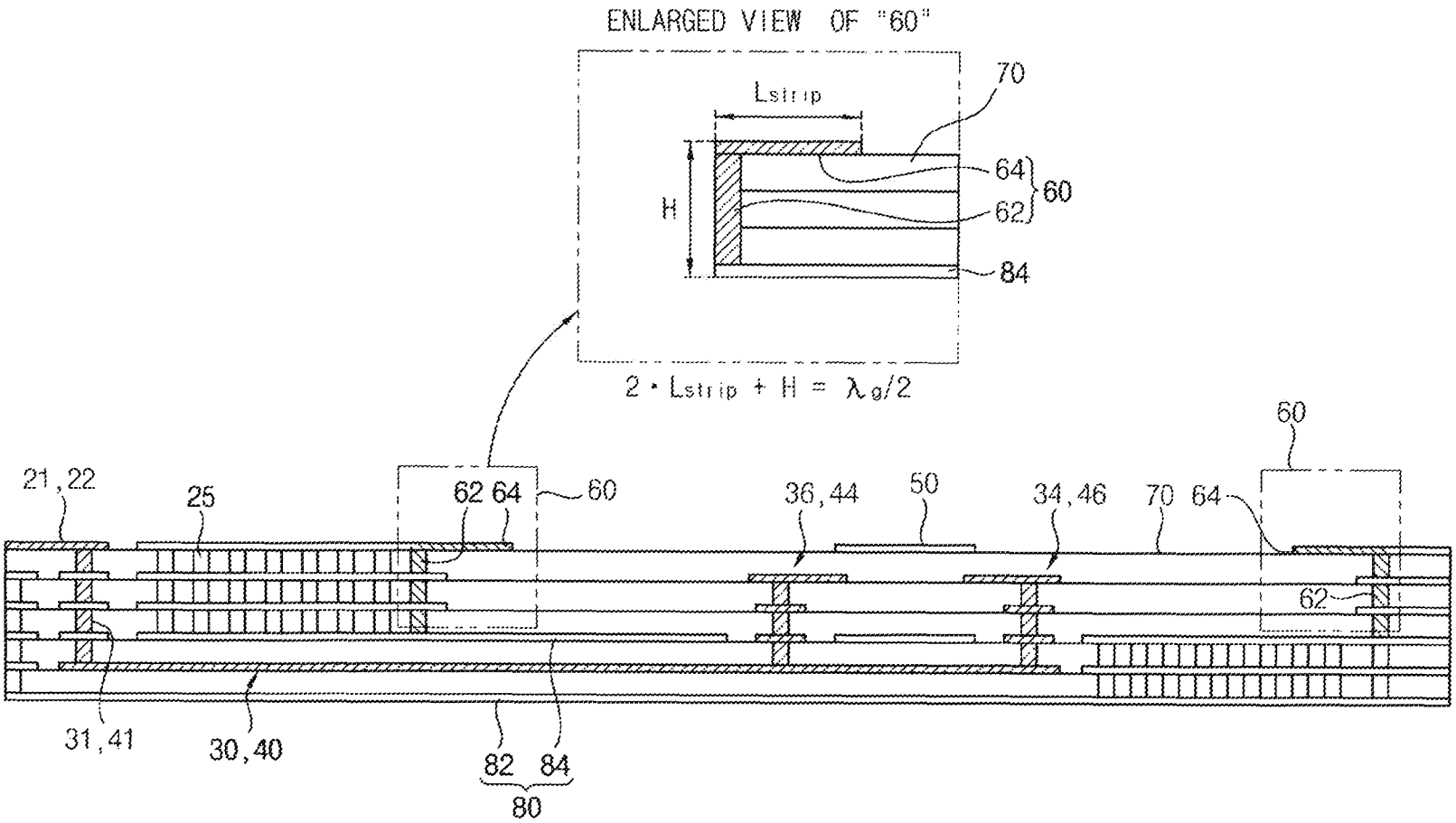
FIG. 4 is a cross-sectional view of the dual-polarized antenna when viewed in the direction of an arrow ("A" direction) in FIG. 3.

In FIG. 1, illustrated is a perspective view showing a structure of a dual-polarized antenna 10, according to an exemplary embodiment. FIG. 2 illustrates a top view of the dual-polarized antenna 10 shown in FIG. 1, and FIG. 3 is a plan view showing a main configuration inside the dual-polarized antenna 10. In addition, FIG. 4 is a cross-sectional view when viewed in a direction of an arrow marked by 'A' in FIG. 3.

A structure of the dual-polarized antenna 10 will be described with reference to FIGS. 1 to 4. The dual-polarized antenna 10 may include a first differential signal feeding unit 30, a second differential signal feeding unit 40, a patch radiator 50, and a dielectric substrate 70. Furthermore, the dual-polarized antenna 10 may further include a first input port 21, a second input port 22, and a ground portion 80.

The dielectric substrate 70 may be a substrate that supports the arrangement between the conductive components constituting the dual-polarized antenna 10 while ensuring insulation between them. The dielectric substrate 70 may be a rectangular substrate having a predetermined area and height as shown. The dielectric substrate 70 may be formed by bonding a plurality of dielectric layers. A plurality of via holes 75 may be formed in the dielectric substrate 70. At least a part of all the via holes 75 may be filled with a conductive metal material such as copper, aluminum, etc., if necessary.

The patch radiator 50 may be a circular conductor patch having a diameter of a predetermined size, and it may be bonded on the central upper surface of the dielectric substrate 70. The patch radiator 50 may be made in a shape of polygon, such as a rectangle, pentagon, hexagon, etc., in addition to the circular shape.

The first input port 21 and the second input port 22 may be disposed side by side at one edge portion of the dielectric substrate 70. The first and second input ports 21 and 22 may be disposed on the upper surface of the dielectric substrate 70 to facilitate connection with an external signal feeding unit. A vertical polarization input signal may be fed into the first input port 21, and a horizontal polarization input signal may be fed into the second input port 22.

The first differential signal feeding unit 30 may be disposed on the dielectric substrate 70. The first differential signal feeding unit 30 may be configured to convert a vertically polarized signal fed through the first input port 21 into first and second vertically polarized differential signals having a phase difference of 180 degrees between them to be fed into the patch radiator 50. The first and second vertically polarized differential signals may be respectively fed in the directions (i.e., ± first direction) from the opposite sides of the patch radiator 50 toward the center of the patch radiator 50.

In an exemplary embodiment, the first differential signal feeding unit 30 may extend from the first input port 21 through the interior of the dielectric substrate 70 toward one side of the patch radiator 50 and branch into first and second feeding probes 34-2 and 36-2 to form a balun structure at the distal ends thereof. The first differential signal feeding unit 30 can differentially feed vertically polarized signals in the directions facing each other (i.e., in the ±first direction) through the first and second feeding probes 34-2 and 36-2 into first and second portions of the patch radiator 50 which are opposite to each other when viewed from the center of the patch radiator 50.

In an exemplary embodiment, the first differential signal feeding unit 30 may include a first single stripline 32, first and second differential feeding striplines 34-1, and 36-1, and first and second probes 34-2 and 36-2. The first single stripline 32 is a passage to feed the vertically polarized signal inputted through the first input port 21. The first and second differential feeding striplines 34-1 and 36-1 are branched to form a balun structure at an end of the first single stripline 32. The first and second differential feeding striplines 34-1 and 36-1 have a difference in length which corresponds to half of the wavelength ($\lambda_v$) of the vertically polarized signal. And the first and second probes 34-2 and 36-2 may be configured to extend from both the ends of the first and second differential feeding striplines 34-1 and 36-1 to the vicinities of first and second edges of the conductive patch radiator 50, respectively, such that the first and second vertically polarized differential signals can be fed into the patch radiator 50 in the ±first directions through the first and second probes 34-2 and 36-2, respectively.

In an exemplary embodiment, the first differential signal feeding unit 30 may include a first single signal line 33, and first and second signal feeding probe units 34 and 36. The first single signal line 33 may be a conductive line connected to the first input port 21 and extending toward the patch radiator 50.

In an exemplary embodiment, the first single signal line 33 may include a first transition unit 31 and a first single stripline 32. The first transition unit 31 may be connected to the first input port 21 and may extend downward to a predetermined depth in the dielectric substrate 70. The first single stripline 32 may extend from the distal end of the first transition unit 31 by a predetermined length in the horizontal direction toward the patch radiator 50 in the dielectric substrate 70.

The first and second signal feeding probe units 34 and 36 may be branched into two lines 34-1 and 36-1 of the balun structure at the distal end of the first single signal line 32, and extend to the vicinities of the first and second portions of the patch radiator 50. Here, the first and second portions of the patch radiator 50 may be located opposite to each other based on their center on a first straight line passing through the center of the patch radiator 50. In particular, the two lines 34-1, and 36-1 of the balun structure may have a length difference. That is, a first length from the end of the first single signal line 32 to the end probe 34-2 of the first signal feeding probe unit 34 and a second length from the end of the first single signal line 32 to the end probe 36-2 of the second signal feeding probe unit 36 are different from each other. The difference between the first length and the second length may be equal to half of the wavelength ($\lambda_v$) of the vertically polarized signal fed through the first input port 21.

In an exemplary embodiment, the first and second signal feeding probe units 34 and 36 may include first and second differential striplines 34-1 and 36-1, and L-shaped first and second probes 34-2 and 36-2. The first and second differential striplines 34-1 and 36-1 may be branched from the distal end of the first single stripline 32 in opposite directions along the first straight line and extend to have the difference of length which is equal to half of the wavelength ($\lambda_v$) of the vertically polarized signal. The L-shaped first and second probes 34-2 and 36-2 may extend upward to a predetermined level within the dielectric substrate 70 from the distal ends of the first and second differential striplines 34-1 and 36-1, respectively, and be bent to extend in the horizontal direction toward the first and second portions of the patch radiator 50, respectively.

Being disposed in the dielectric substrate 70, the second differential signal feeding unit 40 may be configured to convert a horizontally polarized signal fed through the second input port 22 into first and second horizontally polarized differential signals having a phase difference of 180 degrees between each other and to feed the converted first and second horizontally differential polarized signals into the patch radiator 50. The first and second horizontally polarized differential signals may be respectively fed in the opposite directions (i.e., ±second directions) from the opposite sides of the patch radiator 50 toward the center of the patch radiator 50. The ± second directions in which the first and second horizontally polarized differential signals are fed to the patch radiator 50 may be coplanar with and substantially orthogonal to the ±first directions in which the first and second vertically polarized differential signals are fed to the patch radiator 50.

In an exemplary embodiment, the second differential signal feeding unit 40 may extend from the second input port 22 toward the other sides of the patch radiator 50 through the interior of the dielectric substrate 70 and be branched into third and fourth feeding probes 44-2 and 46-2 at the distal ends to form another balun structure. The second differential signal feeding unit 40 can differentially feed the horizontally polarized signals in opposite directions (i.e., in the ± second direction) to third and fourth portions of the patch radiator 50 which are opposite to each other based on the center of the patch radiator 50 through the third and fourth feeding probes 44-2 and 46-2.

In an exemplary embodiment, the second differential signal feeding unit 40 may include a second single stripline 42, third and fourth differential feeding striplines 44-1 and 46-1, and third and fourth probes 44-2 and 46-2. The second single stripline 42 may be a passage through which the horizontally polarized signal fed into the second input port 22 propagates. The third and fourth differential feeding striplines 44-1 and 46-1 may be branched into a balun structure at the distal end of the second single stripline 42, and have a difference of length between them which correspond to half of a wavelength ($\lambda_h$) of the horizontally polarized signal. And the third and fourth probes 44-2 and 46-2 may be configured to extend from the distal ends of the third and fourth differential feeding striplines 44-1 and 46-1 to the vicinities of the third and fourth edges of the patch radiator 50, respectively so as to feed the first and second horizontally polarized differential signals in the ± second directions, respectively.

In an exemplary embodiment, the second differential signal feeding unit 40 may include a second single signal line 43, and third and fourth signal feeding probe units 44 and 46. The second single signal line 43 may be a conductive line connected to the first input port 21 and extending toward the patch radiator 50.

In an exemplary embodiment, the second single signal line 43 may include a second transition unit 41 and a second single stripline 42. The second transition unit 41 may be connected to the second input port 22 and may extend downward to a predetermined depth in the dielectric substrate 70. The second single stripline 42 may extend from the distal end of the second transition unit 41 by a predetermined length in the horizontal direction toward the patch radiator 50 in the dielectric substrate 70.

The third and fourth feeding probe units 44 and 46 may be branched into two lines 44-1 and 46-1 of the balun structure at the distal end of the second single signal line 42, and extend to the vicinities of the third and fourth portions of the patch radiator 50. Here, the third and fourth portions of the patch radiator 50 may be located opposite to each other based on their center on a second straight line passing through the center of the patch radiator 50. In particular, the two lines 44-1 and 46-1 of the balun structure may have a length difference. That is, a third length from the end of the second single signal line 42 to the end probe 44-2 of the third signal feeding probe unit 44 and a fourth length from the end of the second single signal line 42 to the end probe 46-2 of the fourth signal feeding probe unit 46 are different from each other. The difference between the third length and the fourth length may be equal to half of the wavelength ($\lambda_h$) of the horizontally polarized signal fed through the second input port 22. The second straight line may be orthogonal to the first straight line in the same plane.

In an exemplary embodiment, the third and fourth signal feeding probe units 44 and 46 may include third and fourth differential striplines 44-1 and 46-1, and L-shaped third and fourth probes 44-2 and 46-2. The third and fourth differential striplines 44-1 and 46-1 may be branched from the distal end of the first single stripline 42 in opposite directions along the second straight line and extend to have the difference of length which is equal to half of the wavelength ($\lambda_v$) of the horizontally polarized signal. The L-shaped third and fourth probes 34-2 and 36-2 may extend upward to a predetermined level within the dielectric substrate 70 from the distal ends of the third and fourth differential striplines 44-1 and 46-1, respectively, and be bent to extend in the horizontal direction toward the third and fourth portions of the patch radiator 50, respectively.

On the other hand, in an exemplary embodiment, the dual polarization antenna 10 may further include a soft surface structure 60. The soft surface structure 60 may include a conductive vertical fence unit 62 arranged in an annular form and an annular or donut-shaped conductive horizontal roof unit 64. The soft surface structure 60 may be configured to improve radiation characteristics by suppressing surface waves propagating through the surface portion of the dielectric substrate 70.

In an exemplary embodiment, the horizontal roof unit 64 may surround the feeding probes 34-2 and 36-2 of the first differential signal feeding unit 30 and the feeding probes 44-2 and 46-2 of the second differential signal feeding portion 40. The feeding probes 34-2 and 36-2 are to feed the first and second vertically polarized differential signals into the patch radiator 50, respectively, and the feeding probes 44-2 and 46-2 are to feed the first and second horizontally polarized differential signals into the patch radiator 50, respectively. The horizontal roof unit 64 may be formed of a conductive stripline. The conductive stripline may protrude by a predetermined length ($L_{strip}$) in the horizontal direction from the top of the vertical fence unit 62 toward the patch radiator 50 and cover the top surface of the dielectric substrate 70 in an annular strip shape. The vertical fence unit 62 may be coupled to the bottom surface of the horizontal roof unit 64 and extended to the ground portion 80 downward to be grounded.

In an exemplary embodiment, the conductive vertical fence unit 62 may have an annular arrangement so as to surround the patch radiator 50, the first and second signal feeding probe units 34 and 36, and third and fourth signal feeding probe units 44 and 46. For example, the vertical fence unit 62 may include a plurality of vertical conductive pillars 62-1, 62-2, . . . and 62-N. The plurality of vertical conductive pillars 62-1, 62-2, . . . and 62-N may be conductive pillars which fill up a plurality of vertical via holes provided at predetermined intervals along a closed circumference in the dielectric substrate 70. The plurality of vertical conductive pillars 62-1, 62-2, . . . and 62-N may be arranged in a form of an annular fence surrounding the patch radiator 50, the first and second signal feeding probe units 34, and 36, and the third and fourth signal feeding probe units 44, and 46. The lower ends of the plurality of vertical conductive pillars 62-1, 62-2, . . . and 62-N may be electrically connected to the ground portion 80.

In an exemplary embodiment, the donut-shaped conductive horizontal roof unit 64 may be composed of an annular or donut-shaped conductive stripline which is coupled to the top of the annular conductive vertical fence unit 62, and protrudes in the horizontal direction toward the patch radiator 50 by a predetermined length ($L_{strip}$). The cross-sectional shape of the combination of the vertical fence unit 62 and the horizontal roof unit 64 may form an inverted 'L' shape.

In an exemplary embodiment, the soft surface structure 60 may be formed to satisfy the condition of '$2L_{strip}+H=\lambda_g/2$'. Here, H is the height of the vertical fence unit 62, and $L_{strip}$ is the length in which the horizontal roof unit 64 protrudes in the horizontal direction from the top of the vertical fence unit 62. And $\lambda_g$ represents the wavelength of the feed signal in the dielectric substrate 70.

The grounding portion 80 may be disposed to be groundable at a predetermined position on the dielectric substrate 70. The grounding portion 80 may allow the patch radiator 50, and the first and second differential signal feeding units 30 and 40 to be electromagnetically shielded from the outside.

In an exemplary embodiment, the grounding portion 80 may include a first grounding plate 82 laminated on the bottom surface of the dielectric substrate 70, and a second grounding plate 84 disposed inside the dielectric substrate 70 and on the first and second differential signal feeding units 30 and 40. The first grounding plate 82 and the second grounding plate 84 may electromagnetically shield the first and second differential signal feeding units 30 and 40 from the outside by covering the lower and upper sides of the first and second differential signal feeding units 30 and 40.

In an exemplary embodiment, to manufacture the dual-polarized antenna 10 in the structure described above, a plurality of dielectric substrates on each of which a conductor thin film (e.g., copper or aluminum thin film) is deposited may be prepared. The plurality of dielectric substrates may be subject to etching process to obtain desired conductive line patterns. Through the etching process, the conductor thin films deposited on the dielectric substrates can be removed, leaving only the desired conductive line patterns. The conductive line patterns may be different depending on the layer in which the corresponding dielectric substrate is located. The dual-polarized antenna 10 illustrated in FIG. 5 uses a 5-layer stacked dielectric substrate in which five dielectric substrates are stacked. Further, a plurality of via holes may be formed at desired positions in each dielectric substrate. The via holes may be used to form conductor portions or conductor portions in the vertical direction, including the annular conductive vertical fence unit 62.

Through the etching process, desired conductive line patterns may be formed on respective dielectric substrates. In order to electrically connect desired conductive line patterns between the dielectric substrate layers, desired via holes may be formed in each dielectric substrate and filled with a conductive metal therein. Accordingly, conductive line patterns formed on different dielectric substrate layers may be connected to each other in a desired type and/or a desired vertical conductive line can be formed.

After all of the desired conductive lines are formed on each dielectric substrate layer through the above process, all the dielectric substrates may be stacked and bonded by applying a strong pressure. Through this, a desired dual-polarized antenna 10 can be obtained.

In the dual-polarized antenna 10 having such a structure, radio carrier signals may be applied through the first input port 21 and the second input port 22, respectively. The carrier signal applied to the first input port 21 may be a signal for vertical polarization, and the signal applied to the second input port 22 may be a signal for horizontal polarization.

The vertically polarized signal may be radiated through the following process. The radio carrier signal for the vertical polarization may proceed to the first and second signal feeding probe units 34 and 36 of the balun structure through the first transition unit 31 and the first single stripline 32 of the first differential signal feeding unit 30. The radio carrier signal may be made into differential signals having a phase difference of 180 degrees through the first and second signal feeding probe units 34 and 36 of the balun structure. The differential signals may be differentially fed to the patch radiator 50 electromagnetically coupled with the feeding probes 34-2 and 36-2 at the distal ends of the first and second signal feeding probe units 34 and 36. The first and second feeding probes 34-2 and 36-2 may vertically polarize the differential signals and apply them to the patch radiator 50, respectively. The first feeding probe 34-2 may perform vertical polarization (+) feeding, and the second feeding probe 36-2 may perform vertical polarization (−) feeding. Accordingly, a vertically polarized signal may be radiated from the patch radiator 50.

The horizontally polarized signal may also be radiated through the same process as the vertically polarized signal. The radio carrier signal for the horizontal polarization may proceed to the third and fourth signal feeding probe units 44 and 46 of the balun structure through the second transition unit 41 and the second single stripline 42 of the second differential signal feeding unit 40, and then be made into differential signals having a phase difference of 180 degrees. The differential signals are differentially fed into the patch radiator 50 electromagnetically coupled with the feeding probes 44-2 and 46-2 at the ends of the third and fourth signal feeding probe units 44 and 46. The feeding probes 44-2 and 46-2 at the ends of the third and fourth feeding probe units 44 and 46 may horizontally polarize the fed differential signals and apply them to the patch radiator 50, respectively. The third feeding probe 36-2 may perform horizontal polarization (+) feeding, and the fourth feeding probe 46-2 may perform horizontal polarization (−) feeding, so that the horizontally polarized signal may be radiated from the patch radiator 50.

Figure 5:
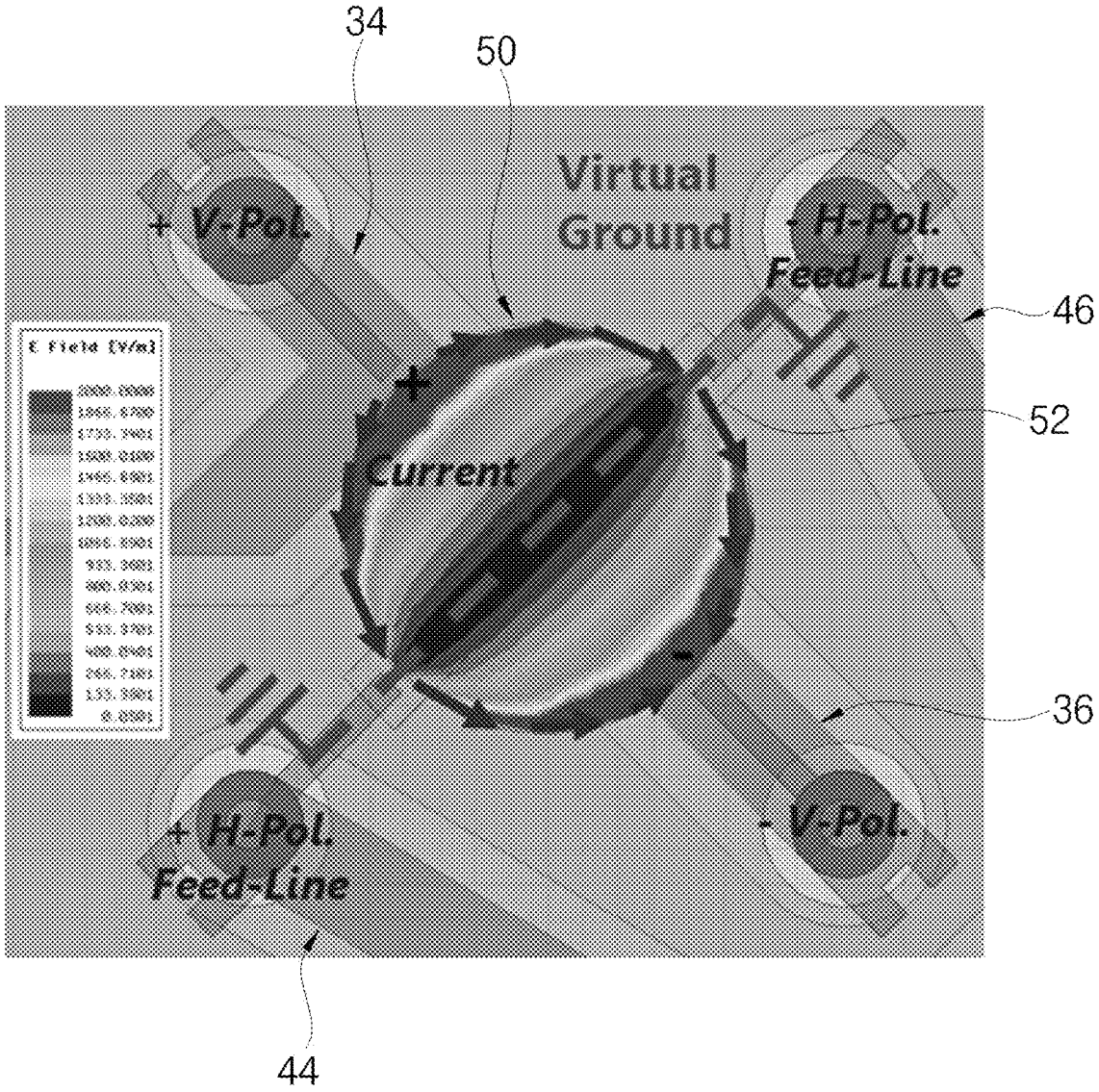
FIG. 5 shows strength and current distribution of an electric field (E-Field) appearing on a patch radiator when a signal is fed to a vertically polarized feeding probe to the dual-polarized antenna shown in FIG. 1.

FIG. 5 shows strength and current distribution of an electric field (E-Field) appearing on a patch radiator 50 at a 120 GHz frequency when the differential radio carrier signals are applied only to the first and second feeding probes 34-2 and 36-2 for the vertical polarization feeding to the dual-polarized antenna 10 shown in FIG. 1.

With reference to FIG. 5, a virtual ground region in which there is almost no electric field (E-Field) such as the central portion 52 of the patch radiator 50 may be formed as the radio wave signals are differentially fed from the first and second feeding probes 34-2 and 36-2 for the vertical polarization feeding to the patch radiator 50. In the central region, the cross-polarization component of the lines of the third and fourth feeding probes 44-2 and 46-2 for the horizontal polarization feeding may be greatly reduced, and is almost non-existent. Accordingly, the current flowing into the third and fourth feeding probes 44-2 and 46-2 for the horizontal polarization feeding may be greatly reduced, so that the isolation between the dual polarizations of the vertical polarization and the horizontal polarization can be greatly increased.

Figure 6:
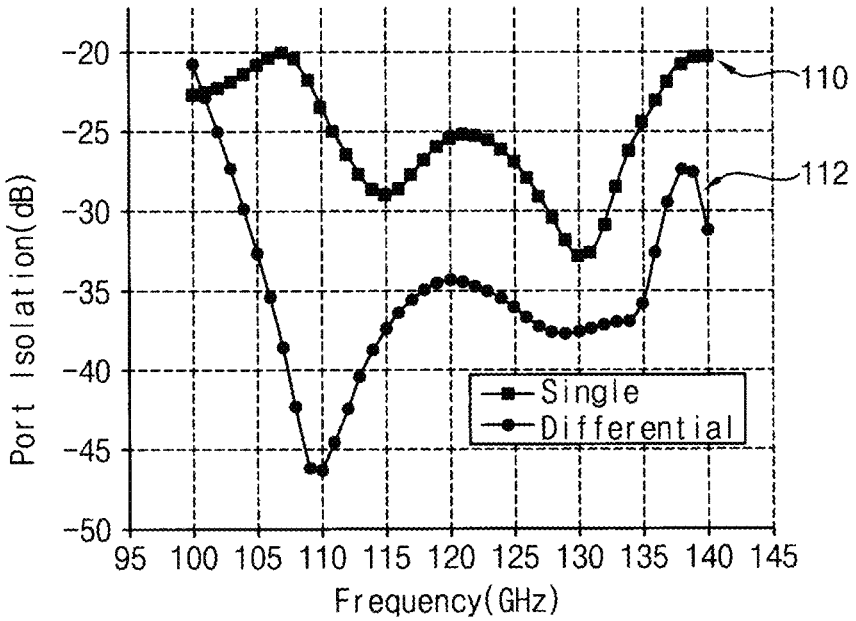
FIG. 6 shows an antenna port isolation (A) and an antenna polarization isolation difference (B) between a single feed dual-polarized antenna and a differential feed dual-polarized antenna.
Figure 6:
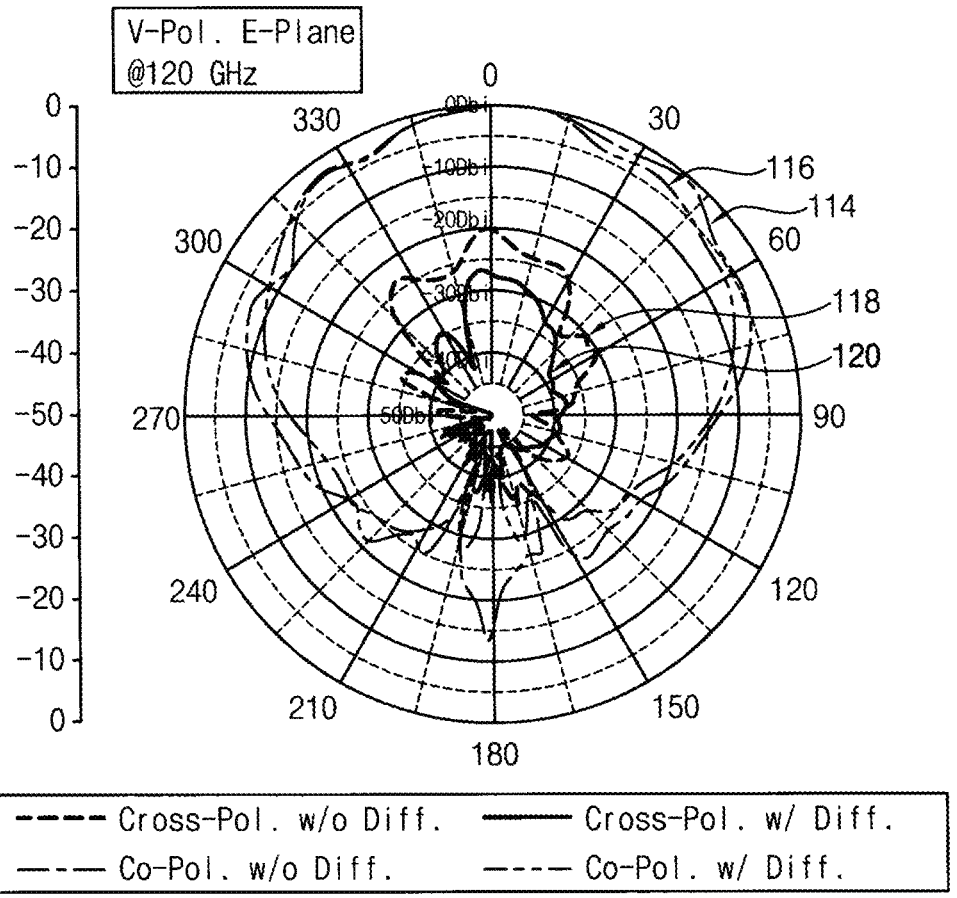

FIG. 6 shows an antenna port isolation (A) and an antenna polarization isolation difference (B) between a single feed dual-polarized antenna and a differential feed dual polarized antenna. Here, the single feed dual-polarized antenna has a structure in which only the first and third signal feeding probe units 34 and 44 are provided in the structure of the dual-polarized antenna 10, but the second and fourth signal feeding probe units 36 and 46 are not provided.

Referring to (A) of FIG. 6, it has a 105 GHz-140 GHz broadband impedance matching characteristics. In addition, it can be seen that the isolation 112 between the dual polarization ports of the differential feed dual-polarized antenna can be improved by up to 20 dB in the wide operating frequency band of 105 GHz-135 GHz compared to the isolation 110 between the polarized ports of the single feed dual-polarized antenna.

The antenna polarization isolation difference is a difference between co-polarization and cross-polarization. Referring to (B) of FIG. 6, reference numerals 114 and 116 denote co-polarization radiation patterns of the single feed dual-polarized antenna and the differential feed dual-polarized antenna 10, respectively. Reference numerals 118 and 120 denote cross-polarization radiation patterns of the single feed dual-polarized antenna and the differential feed dual-polarized antenna 10, respectively. The cross-polarization radiation pattern 120 of the differential feed dual-polarized antenna 10 is about 7 dBi-8 dBi smaller in a bore-sight direction (θ=0 degree) than the cross-polarization radiation pattern 118 of the single feed dual-polarized antenna. It is meant that the differential feed dual-polarized antenna 10 has a higher degree of isolation between the dual polarizations.

Figure 7:
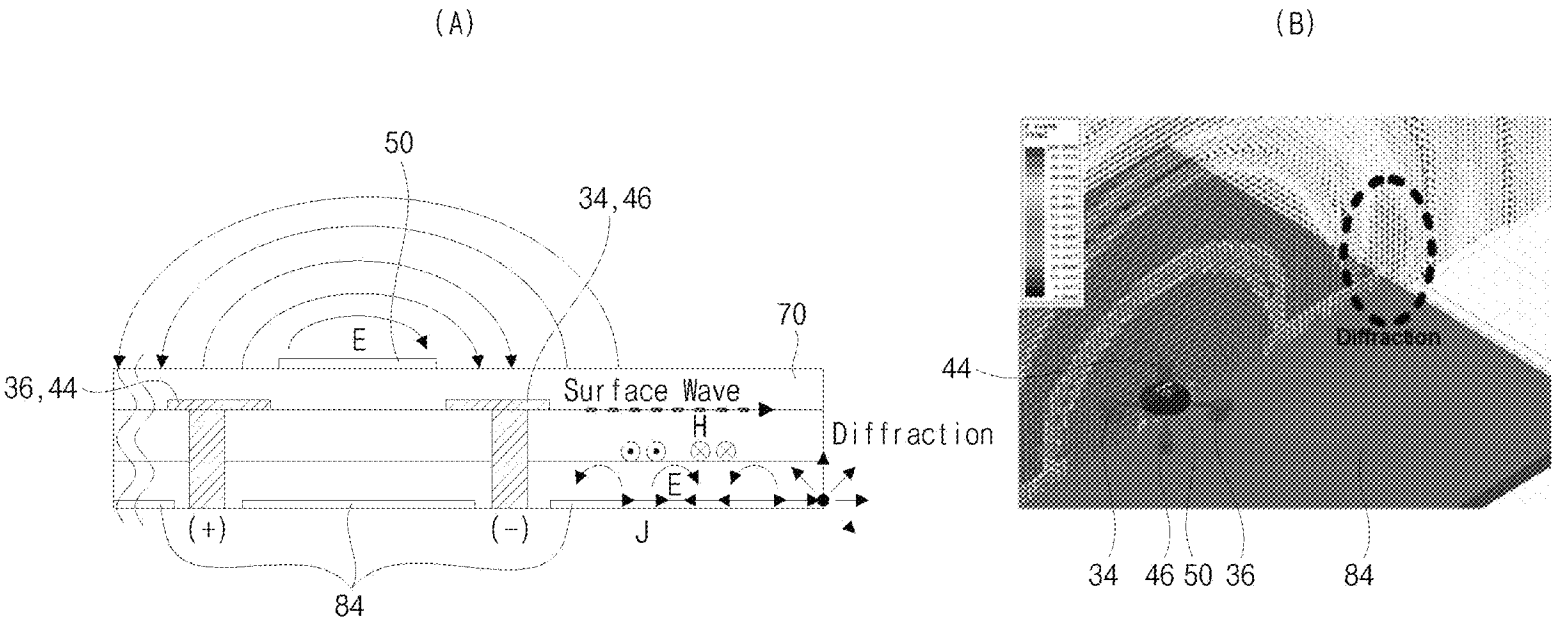
FIG. 7 shows a radio wave radiation pattern of a general patch antenna without a soft surface structure in a dual patch antenna.

FIG. 7 illustrates a radio signal radiation pattern of a general patch antenna without the soft surface structure 60 in the dual-polarized antenna 10.

In the general patch antenna as shown in FIG. 7, the antenna gain may be reduced at a specific frequency by a surface wave and ripples may occur in the radiation pattern. In the case of a general patch antenna without the soft surface structure 60, a part of the radiated signal may be trapped in the dielectric substrate 70 as shown. The trapped radio waves, that is, the surface wave moves along the dielectric substrate 70 and the ground plate 84. When the radio wave reaches the end of the ground plate 84, it diffracts without proceeding further. The diffracted wave may be combined with the wave radiated from the patch radiator 50 to decrease the antenna gain and cause ripples in the radiation pattern.

Figure 8:
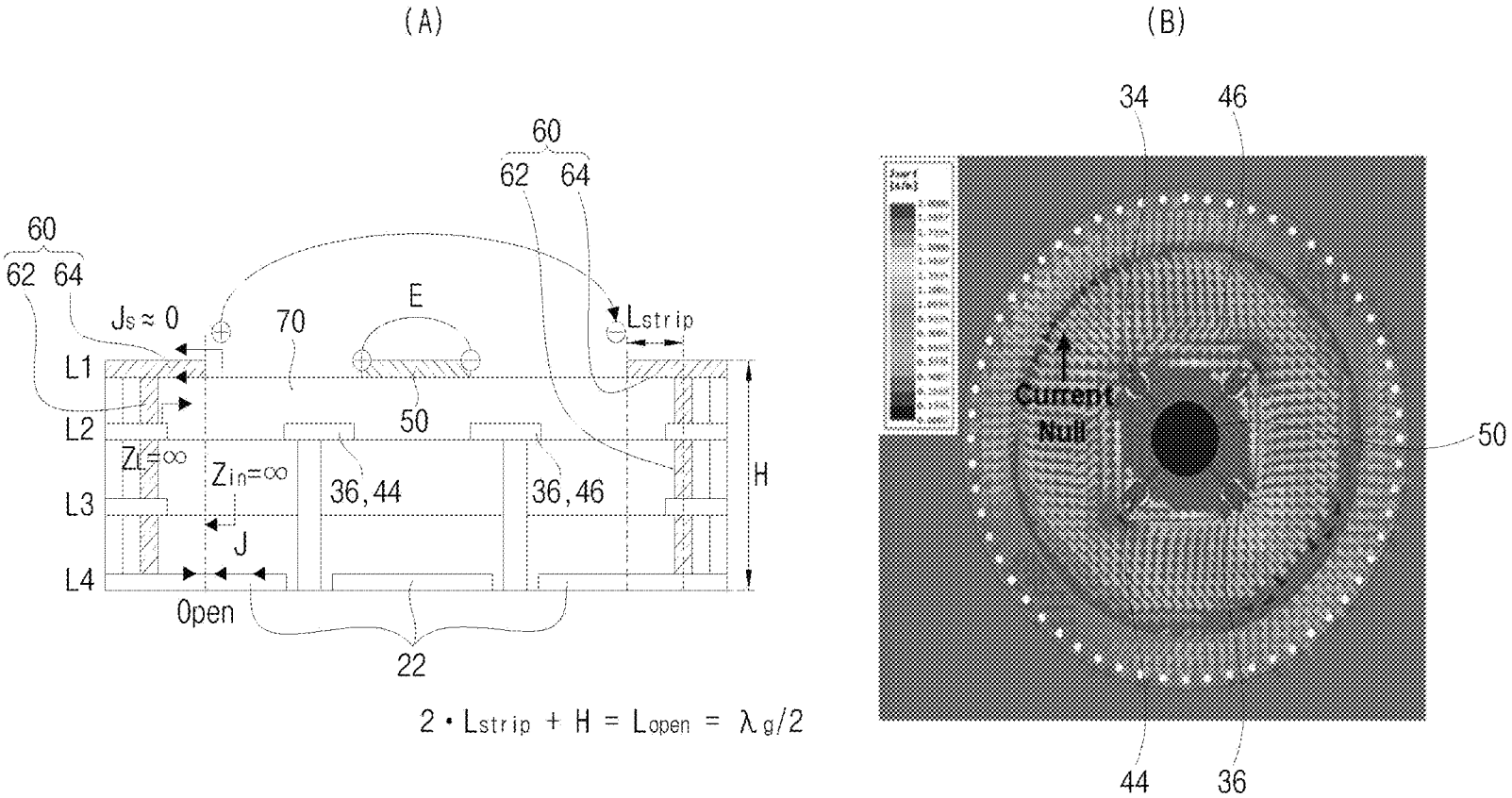
FIG. 8 is a view for describing a principle of operation of a dual-polarized antenna employing the soft surface structure.

FIG. 8 is a view for describing a principle of operation of the dual-polarized antenna 10 incorporating the soft surface structure 60.

Referring to FIG. 8 together with FIG. 4, the dual-polarized antenna 10 employing the soft surface structure 60 can have a wide-band antenna gain and improved a radiation pattern due to the soft surface structure 60. Specifically, the soft surface structure part 60 including the vertical fence unit 62 and the horizontal roof unit 64 coupled thereon can be a soft surface acting as an infinite impedance ($Z_{in}=\infty$) with respect to the surface wave, and suppress propagation of the surface wave by the role of the soft surface (current $J_S=0$) when a condition of '$2L_{strip}+H=\lambda_g/2$' is satisfied. Here, H is a height of the vertical fence unit 62, and $L_{strip}$ is a length that the horizontal roof unit 64 protrudes in the horizontal direction from the top of the vertical fence unit 62. And $\lambda_g$ represents a wavelength of the feed wave in the dielectric substrate 70.

The surface wave propagated by being trapped in the dielectric substrate 70, which may be a part of the signal radiated from the patch radiator 50, may move along the dielectric substrate 70 and the grounding plate 84, but cannot proceed further when it meets the soft surface which acts as an infinite impedance. Referring to (B) of FIG. 8, it can be seen that the surface wave cannot proceed further when it meets the soft surface, and thus a phenomenon of current null occurs in the grounding plate 84 of the bottom layer L4. Therefore, the diffraction phenomenon of the surface wave does not occur at the end of the grounding plate 84 as mentioned in FIG. 7. As a result, the surface wave propagating through the dielectric substrate 70 and the grounding plate 84 can be suppressed using the soft surface structure 60, thereby improving antenna gain and radiation pattern.

Figure 9:
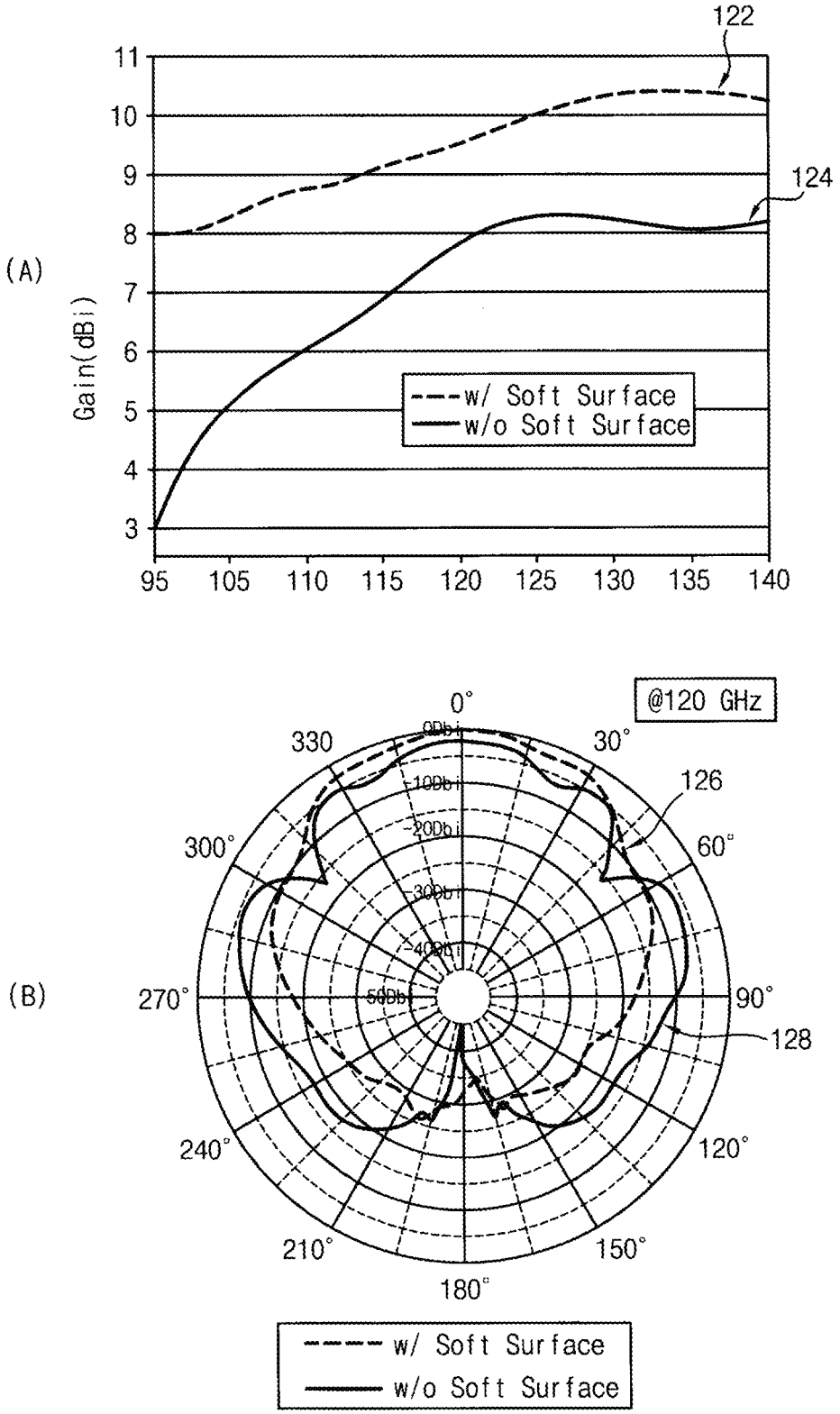
FIG. 9 shows improvement degree of antenna gain (A) and radiation pattern (B) due to the introduction of the soft surface structure, according to an exemplary embodiment of the present disclosure.

FIG. 9 shows improvement degree of antenna gain (A) and radiation pattern (B) due to the introduction of the soft surface structure 60, according to an exemplary embodiment of the present disclosure.

In (A) of FIG. 9, reference numerals 122 and 124 denote antenna gains with frequency when the soft surface structure 60 is employed and when not employed, respectively. The antenna gain is increased through the soft surface structure 60 to show that the dual-polarized antenna 10 has broadband characteristics.

In (B) of FIG. 9, reference numerals 126 and 128 denote the vertically polarized radiation patterns (E-plane) when the soft surface structure 60 is employed and when not employed, respectively. Side lobes and ripples which appear in the vertically polarized radiation pattern 128 when the soft surface structure 60 is not employed are greatly reduced by employing the soft surface structure 60, thereby making an improvement in the radiation pattern of vertically polarized waves.

TABLE 1

Comparison between dual-polarized antennas

| Publisher | Freq. | Antenna Type | Impedance BW | Peak Gain | Port Isolation | Polarization Isolation |
|---|---|---|---|---|---|---|
| 2018 JSSC | 60 GHz | Stacked Patch Antenna With Proximity Coupling | 8 GHz(=13%) | 3.5 dBi | — | >11 dB |
| 2013 TAP | 82 GHz | Aperture Coupled Stacked Patch Antennas | 23 GHz(=23.4%) | 7.25 dBi | >17.8 dB | >17.8 dB |
| 2016 AWPL | 93 GHz | Mesh Array Antenna | 7 GHz(=7.5%) | 13.3 dBi | >16 dB | >6 dB |
| This Work | 120 GHz | Differential Patch Antenna With Soft Surface | 30 GHz(=25%) | 7.6 dBi | >34 dB | >25 dB |

Table 1 is a table comparing various dual-polarized antennas. Conventional dual-polarized antennas have a narrow operating frequency bandwidth or low isolation between dual polarizations. When compared to the conventional dual-polarized antennas, the dual-polarized antenna 10 according to the present disclosure has a wider frequency bandwidth of 30 GHz, and a higher isolation between dual polarizations, that is, a port isolation of 34 dB or more and a polarization isolation of 25 dB or more. Therefore, it can be seen that the dual-polarized antenna 10 according to the present disclosure is an antenna suitable for use in the dual-polarized MIMO system.

The present disclosure can increase the isolation between the dual polarizations in a wide frequency bandwidth by differentially feeding with the dual-polarized antenna. The degree of improvement is superior to that of the conventional dual-polarized antenna, so it can be used in a variety of MIMO wireless communication systems where channel isolation is important. In addition, the dual-polarized antenna according to the present disclosure can be operated in a wide frequency bandwidth and thus is suitable for ultra-high-speed wireless communication in which frequency bandwidth is important.

As described above, although a few example embodiments have been described with limited drawings, those skilled in the art will readily appreciate that many modifications are possible in the example embodiments without materially departing from the novel teachings and advantages of the present disclosure. For example, the described techniques may be performed in a different order than the described method. In addition, proper results can be achieved even if the elements of the described system, structure, device, circuit, etc. are combined in a different form from the described method, substituted or replaced by other elements or equivalents. Accordingly, all such modifications are intended to be included within the scope of the present disclosure as defined in the claims.

What is claimed is:

1. A dual-polarized antenna, comprising:

a dielectric substrate;

a conductive patch radiator laminated on a top surface of the dielectric substrate and having a predetermined size and shape;

a first differential signal feeding unit disposed on the dielectric substrate, and configured to convert a vertically polarized signal into first and second vertically polarized differential signals having a phase difference of 180 degrees between each other to be fed in opposite first directions toward a center of the conductive patch radiator from opposite sides about the center of the conductive patch radiator;

a second differential signal feeding unit disposed on the dielectric substrate, and configured to convert a horizontally polarized signal into first and second horizontally polarized differential signals having a phase difference of 180 degrees between each other to be fed in opposite second directions toward the center of the conductive patch radiator from opposite sides about the center of the conductive patch radiator, and a soft surface structure unit which includes a horizontal roof unit formed of a conductive stripline surrounding at least the patch radiator, feeding probes of the first differential signal feeding unit for feeding the first and second vertically polarized differential signals to the patch radiator, respectively, and feeding probes of the second differential signal feeding unit for feeding the first and second horizontally polarized differential signals to the patch radiator, respectively; and a conductive vertical fence unit coupled to a bottom surface of the horizontal roof unit and extending downward to be ground, wherein the soft surface structure unit is configured to improve radiation characteristics by suppressing a surface wave propagating through a surface portion of the dielectric substrate.

2. The dual-polarized antenna of claim 1, wherein the first differential signal feeding unit comprises a first single stripline to which the vertically polarized signal is fed; first and second differential feeding striplines branched from an end of the first single stripline into a balun structure and having a length difference corresponding to half of a wavelength ($\lambda_v$) of the vertically polarized signal between each other; and first and second probes extending from ends of the first and second differential feeding striplines to vicinities of first and second edges of the conductive patch radiator to feed the first and second vertically polarized differential signals in the opposite first directions, respectively.

3. The dual-polarized antenna of claim 1, wherein the second differential signal feeding unit comprises a second single stripline to which the horizontally polarized signal is fed; third and fourth differential feeding striplines branched from an end of the second single stripline into a balun structure and having a length difference corresponding to half of a wavelength ($\lambda_h$) of the horizontally polarized signal between each other; and third and fourth probes extending from ends of the third and fourth differential feeding striplines to vicinities of third and fourth edges of the conductive patch radiator to feed the first and second horizontally polarized differential signals in the opposite second directions, respectively.

4. The dual-polarized antenna of claim 1, wherein the horizontal roof unit protrudes a predetermined length ($L_{strip}$) in a horizontal direction from a top of the vertical fence unit toward the patch radiator to cover a top surface of the dielectric substrate in an annular band shape, and the soft surface structure unit satisfies a condition of '$2L_{strip}+H=\lambda_g/2$', where H is a height of the vertical fence unit, $L_{strip}$ is a length where the horizontal roof unit protrudes horizontally from the top of the vertical fence part, and $\lambda_g$ is a wavelength of feed signal in the dielectric substrate.

5. The dual-polarized antenna of claim 1, further comprising a first input port, disposed on a side of the dielectric substrate, and through which the vertically polarized signal is input; a second input port, disposed on another side of the dielectric substrate, and through which the horizontally polarized signal is input; and a grounding unit, disposed to be grounded at a predetermined position of the dielectric substrate, and configured to electromagnetically shield the patch radiator and the first and second differential signal feeding units from an outside.

6. The dual-polarized antenna of claim 1, wherein the opposite first directions are substantially orthogonal to the opposite second directions on the same plane.

7. A dual-polarized antenna, comprising:

a dielectric substrate;

a conductive patch radiator laminated on a top surface of the dielectric substrate and having a predetermined size and shape;

a first input port, disposed on a side of the dielectric substrate, and through which a vertically polarized signal is input;

a second input port, disposed on another side of the dielectric substrate, and through which a horizontally polarized signal is input;

a first differential signal feeding unit extending from the first input port toward one side of the patch radiator through the dielectric substrate, and branched into a balun structure to provide first and second feeding probes for differentially feeding vertically polarized signals to first and second portions, opposite to each other, of the patch radiator; and a second differential signal feeding unit extending from the second input port toward another side of the patch radiator through the dielectric substrate, and branched into a balun structure to provide third and fourth feeding probes for differentially feeding horizontally polarized signals to third and fourth portions, opposite to each other, of the patch radiator;

a grounding unit disposed to be grounded at a predetermined position of the dielectric substrate to electromagnetically shield the patch radiator and the first and second differential signal feeding units from an outside; and a soft surface structure unit including: a conductive vertical fence unit arranged annularly to surround the patch radiator, the first and second feeding probes, and the third and fourth feeding probes; and a donut-shaped conductive horizontal roof unit including a conductive strip line coupled to an upper end of the vertical fence unit along the upper end of the vertical fence unit, and protruding by a predetermined length ($L_{strip}$) in a horizontal direction toward the patch radiator, wherein soft surface structure unit is configured to improve radiation characteristics by suppressing a surface wave propagating inside of the dielectric substrate.

8. The dual-polarized antenna of claim 7, wherein the conductive vertical fence unit of the soft surface structure unit comprises a plurality of vertical conductive pillars constituting an annular fence by filling a plurality of vertical via holes provided at predetermined intervals along an annular closed line in the dielectric substrate, wherein a cross-sectional shape of a combination of the conductive vertical fence unit and the horizontal roof unit is an inverted L-shape.

9. The dual-polarized antenna of claim 8, wherein the soft surface structure unit satisfies a condition of '$2L_{strip}+H=\lambda_g/2$', where H is a height of the vertical fence unit, $L_{strip}$ is a length where the horizontal roof unit protrudes horizontally from the top of the vertical fence part, and $\lambda_g$ is a wavelength of feed signal in the dielectric substrate.

10. The dual-polarized antenna of claim 7, wherein the grounding unit comprises a first ground plate laminated on the bottom surface of the dielectric substrate; and a second ground plate disposed inside the dielectric substrate while being above the first and second differential signal feeding units, and the grounding unit is configured to electromagnetically shield the first and second differential signal feeding units from outside.

11. The dual-polarized antenna of claim 7, wherein the first differential signal feeding unit includes a first single signal line connected to the first input port and extending toward the patch radiator; and first and second feeding probe units branched into two lines of a balun structure from an end of the first single signal line and extending to vicinities of first and second portions of the patch radiator, respectively, and wherein the first and second portions are located opposite to each other based on a center of the patch radiator on a first straight line passing through the center of the patch radiator, and a difference in length between the first and second feeding probe units is substantially equal to half a wavelength ($\lambda_v$) of a vertically polarized signal input to the first input port.

12. The dual-polarized antenna of claim 11, wherein the first single signal line includes a first transition unit connected to the first input port and extending downward to a predetermined depth in the dielectric substrate; and a first single stripline extending from a distal end of the first transition unit by a predetermined length in a horizontal direction toward the patch radiator in the dielectric substrate, and wherein the first and second feeding probe units include first and second differential striplines branched in opposite directions along the first straight line at a distal end of the first single stripline so as to have a length difference equal to half the wavelength ($\lambda_v$) of the vertically polarized signal; and L-shaped first and second probes extending upward from distal ends of the first and second differential striplines to a predetermined level in the dielectric substrate, and then bent to extend horizontally to the first and second portions, respectively.

13. The dual-polarized antenna of claim 7, wherein the first differential signal feeding unit includes a second single signal line connected to the second input port and extending toward the patch radiator; and third and fourth feeding probe units branched into two lines of a balun structure from an end of the second single signal line and extending to vicinities of third and fourth portions of the patch radiator, respectively, and wherein the third and fourth portions are located on opposite sides to each other based on a center of the patch radiator on a second straight line passing through the center of the patch radiator, and a difference in length between the third and fourth probe units is substantially equal to half a wavelength ($\lambda_h$) of a horizontally polarized signal input to the second input port.

14. The dual-polarized antenna of claim 13, wherein the second single signal line includes a second transition unit connected to the second input port and extending downward to a predetermined depth in the dielectric substrate; and a second single stripline extending from a distal end of the second transition unit by a predetermined length in a horizontal direction toward the patch radiator in the dielectric substrate, and wherein the third and fourth feeding probe units include third and fourth differential striplines branched in opposite directions along the second straight line at a distal end of the second single stripline so as to have a length difference equal to half the wavelength ($\lambda_h$) of the horizontally polarized signal; and L-shaped third and fourth probes extending upward from distal ends of the third and fourth differential striplines to a predetermined level in the dielectric substrate, and then bent to extend horizontally to the third and fourth portions, respectively.

15. The dual-polarized antenna of claim 7, wherein the first and second portions are located on a first straight line, and the third and fourth portions are located on a second straight line orthogonal to the first straight line in the same plane.

16. The dual-polarized antenna of claim 7, wherein the first and second differential signal feeding units are electromagnetically coupled to the patch radiator.

* * * * *